United States Patent [19]

Stidworthy

[11] Patent Number: 4,895,045

[45] Date of Patent: Jan. 23, 1990

[54] DIFFERENTIAL CAMSHAFT

[75] Inventor: Frederick M. Stidworthy, Long Compton, United Kingdom

[73] Assignee: LONRHO PLC, London, United Kingdom

[21] Appl. No.: 187,532

[22] PCT Filed: Aug. 21, 1987

[86] PCT No.: PCT/GB87/00597

§ 371 Date: May 23, 1988

§ 102(e) Date: May 23, 1988

[87] PCT Pub. No.: WO88/01337

PCT Pub. Date: Feb. 25, 1988

[30] Foreign Application Priority Data

Aug. 22, 1986 [GB] United Kingdom ..... 8620416

[51] Int. Cl.[4] ..... F16H 53/04

[52] U.S. Cl. ..... 74/568 R; 74/567; 74/838; 474/400

[58] Field of Search ..... 74/568 R, 568 T, 568 FS, 74/567, 838, 395, 665; 474/900

[56] References Cited

U.S. PATENT DOCUMENTS

| | | | |
|---|---|---|---|
| 1,611,063 | 12/1926 | Peiler | 74/568 T |
| 3,633,555 | 1/1972 | Raggi | 74/568 R |
| 4,522,085 | 6/1985 | Kane | 74/568 R |

FOREIGN PATENT DOCUMENTS

| | | | |
|---|---|---|---|
| 2205 | of 1857 | United Kingdom | 74/838 |
| 16221 | of 1908 | United Kingdom | 74/838 |
| 390499 | 4/1933 | United Kingdom | 74/838 |

*Primary Examiner*—Gary L. Smith
*Assistant Examiner*—F. Saether
*Attorney, Agent, or Firm*—Marshall, O'Toole, Gerstein, Murray & Bicknell

[57] ABSTRACT

A camshaft arrangement including a pair of cams (7, 8) mounted on the same camshaft (1) with at least one of the cams rotatable relative to the camshaft (17) and with the cams (7, 8) maintained at a given axial spacing on the camshaft (1), a differential mechanism (a, b, c, d) coupling the two cams (7, 8) together for rotation about the camshaft axis with a selected relative angular phase, and phase adjusting means (14, 15) for acting on the differential mechanism (a, b, c, d) to effect a relative rotation of the cams (7, 8) to adjust the selected angular phase of the cams (7, 8) and thereafter to retain the cams in the adjusted position.

10 Claims, 4 Drawing Sheets

DIFFERENTIAL CAMSHAFT

DESCRIPTION OF INVENTION

This invention is directly, but not exclusively, concerned with the ability to vary the phase, or relative timing, of the inlet and exhaust valves of an internal combustion engine, and, more particularly, with providing means for realising timing variations in respect of single camshaft engines.

BACKGROUND OF THE INVENTION

The benefits of being able to effect such a variation when instigated according to engine speed and load etc., are torque increase, and emission reduction. Furthermore, fuel economy can be drammatically improved over the whole revolution range without power output penalties.

Variable valve timing has been proposed for some considerable time. However, the majority of the solutions proposed are quite complicated and usually require a twin-camshaft engine in order to be effective. The variable abilities rely upon the availability of separate camshafts for the inlet and exhaust valves. This means that by varying one (or both) shaft(s) relative to the other, an advance/retard situation can be realised thereby changing the overlap between the valve cycles and offering a wider "optimum" timing regime.

SUMMARY OF THE INVENTION

The present invention offers these abilities to twin camshaft layouts, but also, and more importantly, provides a means of realising timing variations in respect of single camshaft engines.

The present invention can be applied to single cylinder engines and those employing two or more cylinders. Furthermore, the invention can be used in conjunction with pumping and compressor devices or the like. The present invention can also be used (as herein described) with standard types of cam devices, or in conjunction with annular cams, shafts and followers, wherein the annular cams and/or the followers can be differentiated in the same way as intended for the standard external cams etc.

BRIEF DESCRIPTION OF THE DRAWINGS

In order that the invention may be more readily understood, embodiments thereof will now be described with reference to the accompanying drawings in which.

DETAILED DESCRIPTION OF THE DRAWINGS

Figure 1:
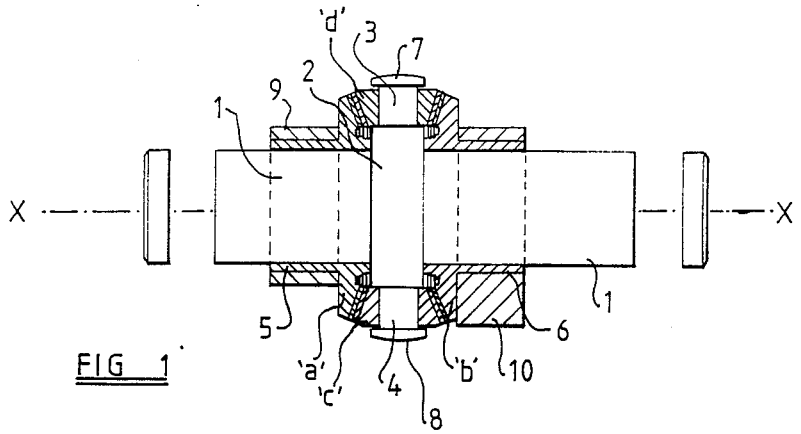
FIG. 1 shows an arrangement embodying the principles of the invention.

Referring now to the Figures, FIG. 1 shows two dams 9, 10, bearing located upon a camshaft 1 in free-running communication. It is assumed that the cams 9, 10 are able to rotate upon camshaft 1 but are restricted from all lateral movement.

A set of bevelled differential gearing a/b/c/d is provided between the two cams 9, 10 with the idler-bevels c, d mounted in free-running bearing location upon stub-axles 3, 4 and retained thereon by end-plates 7, 8. C and d are engaged with bevelled-gears a and b with gear a being fixed to, or part of cam sleeve-shaft 5 and bevelled-gear b being fixed to, or part of cam sleeve-shaft 6.

Cam 9 is fixed to, or part of, sleeve-shaft 5 and cam 10 is fixed to, or part of, sleeve-shaft 6.

It is assumed that shaft 1 is driven by way of a sprocket for example, in the usual way. However, any other suitable drive means could be used. The differential hub 2, being fixed to, or part of, camshaft 1, will, therefore, also be driven.

If the cam assembly 9/5/a were "locked" to shaft 1, then the whole assembly 1/2/3/4/5/6/7/8/9/10/a/b/c/d would rotate en masse. Therefore, if means were provided, whereby the assembly 9/5/a could be rotated relative to shaft 1, preferably in a controlled fashion, then the resultant differential action created between assembly 9/5/a and assembly b/6/10 would be equal and opposite in effect. That is, if cam 9 were advanced relative to shaft 1, then cam 10 would be retarded relative to shaft 1 by a similar rotational amount. Therefore, if it is assumed that cam 9 is an 'inlet' cam and cam 10 is an 'exhaust' cam, then it will be seen that the relative timings can be changed with the overlap being extended, or reduced by any required amount. Furthermore, if (as in a four-valve per cylinder arrangement etc) the two cams 9, 10 were, for example, inlet cams, then it will be appreciated that the overall inlet event could be altered. That is to say, that by causing one inlet cam to advance, and the second to retard, relative to the camshaft 1 the whole event could be extended (or reduced).

The ability to extend or reduce the event is very desirable.

In order to change phase between, for example, cam 9 and shaft 1, a typical type of mechanism can be found in British Patent Application No. 8527525.

If, as described, the two cams 9, 10 are assumed to be inlet and exhaust cams respectively, then it will be understood that by providing differential capabilities between cam 10 and a further inlet cam (not shown), or by fixing a second exhaust cam (not shown) to cam 10, and then providing differential capabilities between this second cam and a further inlet cam (or cams); for example, inlet cam/exhaust cam-exhaust cam/inlet cam-inlet cam etc. (to any combination), with differential capabilities between pairs or single units etc., it is only necessary to provide relative phase changing capabilities between the first cam and the camshaft as all other coupled items will advance and/or retard in unison and by similar amounts.

This ability to provide phase changing capability to a single camshaft is particularly significant.

Any type of gear coupling, capable of differentiation can be used.

Figure 2:
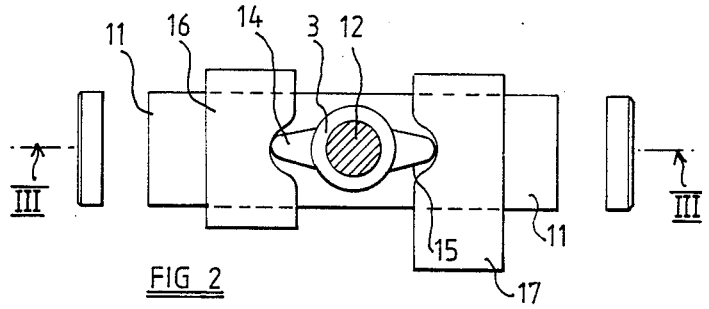
FIG. 2 shows a second embodiment of the invention.
Figure 3:
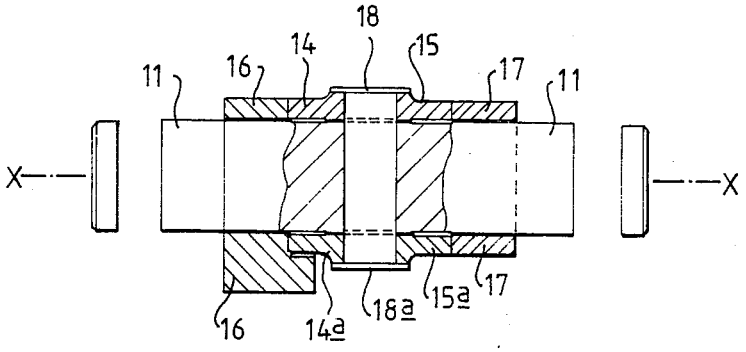
FIG. 3 is a section on the line III—III of FIG. 2.
Figure 4:
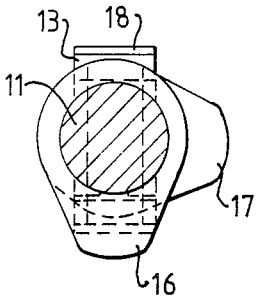
FIG. 4 is an end elevation of FIG. 3.

In FIGS. 2, 3 and 4, the two cams 16, 17 are differentially coupled by way of two levers 14, 15 and 14*a*; 15*a*. These levers are bearing located upon a cross-axle 12 which is fixed to, or part of, camshaft 11. Lever arm 4 is in contact with cam 16 and lever arm 15 in contact with cam 17. Lever 14*a*, 15*a* is included in order to balance the mechanism but is not functionally necessary. End plates 18, 18*a* retain the levers 14, 15 and 14*a*, 15*a* on the axle 12.

It is assumed that cams 16, 17 are laterally restricted, and that the camshaft 11 is bearing supported. Furthermore, the valve-spring loadings applied to the cams 16, 17 would be sufficient to ensure continuous contact between the levers 14, 15 and 14*a*, 15*a* and the cams 16, 17.

If some phase changing mechanism is interposed between either cam and the main shaft 11, then by changing the relative phase of the said cam in relation to the shaft 11, on equal and opposite reaction will be described by the other cam. If the lever arm lengths were not equal, however, arm 14 being longer than arm 15 for example, then the relative rotary motion of cam 16 in relation to shaft 11 would be greater than that of cam 17.

Lever 14, 13, 15 and lever 14*a*, 13*a*, 15*a* would be responsible for driving the two free-running cams 16, 17 together with the "locked" phase changing mechanism (not shown).

A typical eight valve camshaft layout could be as follows:

Inlet-Cam=IC; Exhaust-Cam=EC; Lever=L;
Phase Changing Mechanism=PCM

PCM-IC/L/EC-EC/L/IC-IC/L/EC-EC//L/IC.

The compound cams enabling the use of only four levers between the eight valves.

Figure 5:
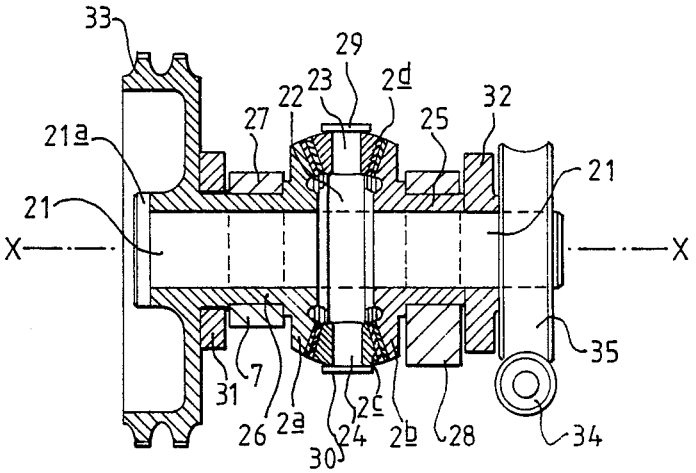
FIG. 5 is a further application of the principles embodying the invention.

In FIG. 5, the use of concentric shafts allows for a very compact layout for this type of differential camshaft embodiment. Sleeve-shaft 6 is provided with the main drive sprocket 33, cam 27 and bevelled-gear a. Sleeve-shaft 25 is provided with cam 28 and bevelled-gear 2*b*. These two assemblies are located in free-running bearing communication upon the 'fixed' concentric center shaft 21. The whole device being bearing located within the main journals 31 and 32.

Center-shaft 21 is provided with end-plate 21*a*, differential hub 22, stub-axles 23, 24, end-plates 29, 30 and worm-wheel 35. This assembly being capable of rotary movement.

Worm-wheel 35 is engaged with worm 34. The lead angle being around 10°, thereby providing a "locking" angle.

If sprocket 33 is rotated, cam 27 will rotate in a similar direction and at a similar speed. If, however, the center-shaft is prevented from movement by the worm-/worm-wheel combination 34, 35, the engaged differential-idler gears 2*a* and 2*d* will cause gear 2*b* to rotate in a direction opposite to that of gear 2*a*. This will, in turn, cause cam 28 to rotate in a direction opposite to that of cam 27 but at the same speed.

If worm 34 is provided with rotational capability in either direction, the center-shaft 21 will be caused to rotate. This will cause a change of phase of any degree in either direction between 27 and 28. The advance/retard capability is adjustable through 360°.

All "solid" block areas represent bearing surfaces and/or devices etc.

Throughout FIGS. 1 to 5, the center rotational datum is indicated 'x'—'x'.

Figure 6:
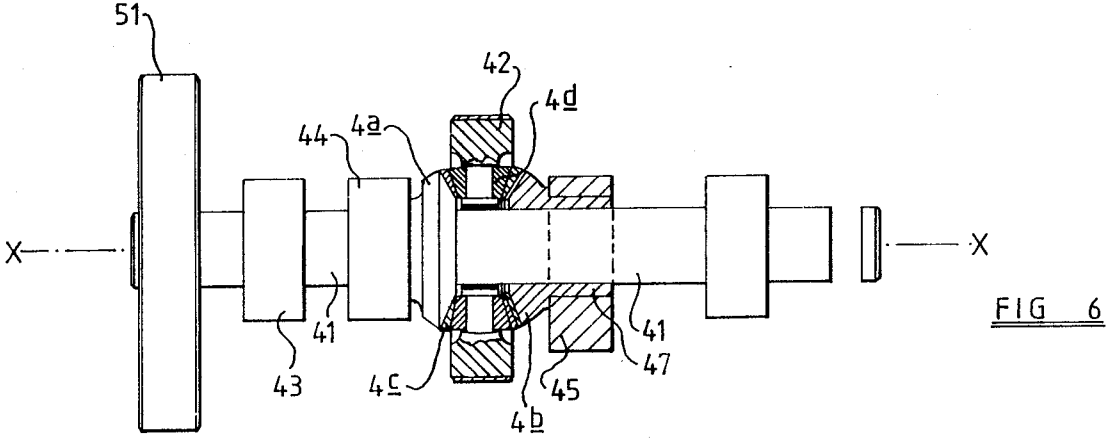
FIG. 6 shows the principles of the inention applied to a differential camshaft having 3 cams per cylinder.

FIG. 6 is a representation of a differential camshaft which features three cams 3, 4 and 5 per cylinder. In some situations, particularly large diesel engines, it is not unusual to find three cams in use: one to operate the inlet valve, one to operate the exhaust valve and a third to provide the introduction of the fuel. If all three cams are mounted upon a single camshaft, then the ability to provide a simple variable valve timing capability is, of course, made more difficult. However, this invention offers that prospect and FIG. 6 provides one solution to the problem.

It is assumed, as with FIGS. 1 and 2, that camshaft 1 is mounted in some kind of bearing location. If carrier-gear 2 is 'locked', and drive is applied to gear 51, then the cams 43, 44 will rotate in the same direction as gear 51. As bevelled-gear 4*a* is fixed to, or part of the main camshaft assembly, this will also rotate in a similar direction as cams 43 and 44. The differential action across idlers 4*c* and 4*d* will, however, cause gear 4*b* to rotate at the same speed as gear 4*a* but in the opposite rotational direction. As cam 455 is fixed to, or part of, concentric sleeve-shaft 47, which is itself fixed to, or part of, gear 4*b*, this too will rotate in the opposite rotational direction to that of the assembly 51, 41, 43, 44, 4*a*, 46.

If carrier-gear 42 is to remain 'locked' (by any suitable means; i.e. a worm/worm-wheel combination etc), then this situation of two cams driving forward with one reversed will remain constant. However, if carrier-gear 42 is caused to rotate by any degree, no matter how small, assembly 4*b*, 47, 45 will be caused to change phase and, depending upon which direction carrier-gear 42 is rotated, cam is advanced or retarded. If the rotational drive applied to gear 42 is continuous, then a totally different, but constant, timing will result. However, if gear 42 is simply rotated through a few degrees and then relocked, then cam 45 will only have changed phase. If gear 42 is rotated through, for example, 5° it should be remembered that cam 45 will in fact rotate, relative to gear 2, 10° owing to differential action. It will be seen, therefore, that in the case of the single camshaft diesel engine, a means for changing the timing of the exhaust (or other) cam can be effected without a major alteration to the basic design.

The inclusion of a carrier-gear 42 enables the 'ganging' of several differentials or, if required, (as in any of the examples herein described), a lay-shaft (not shown) coupling of the assembly 4*b*, 47, 45 with other sleeve-shaft mounted exhaust-cams can be accomplished. Only one differential per camshaft would be required, with the lay-shaft coupling 'ganging' the remaining exhaust valves.

Figure 7:
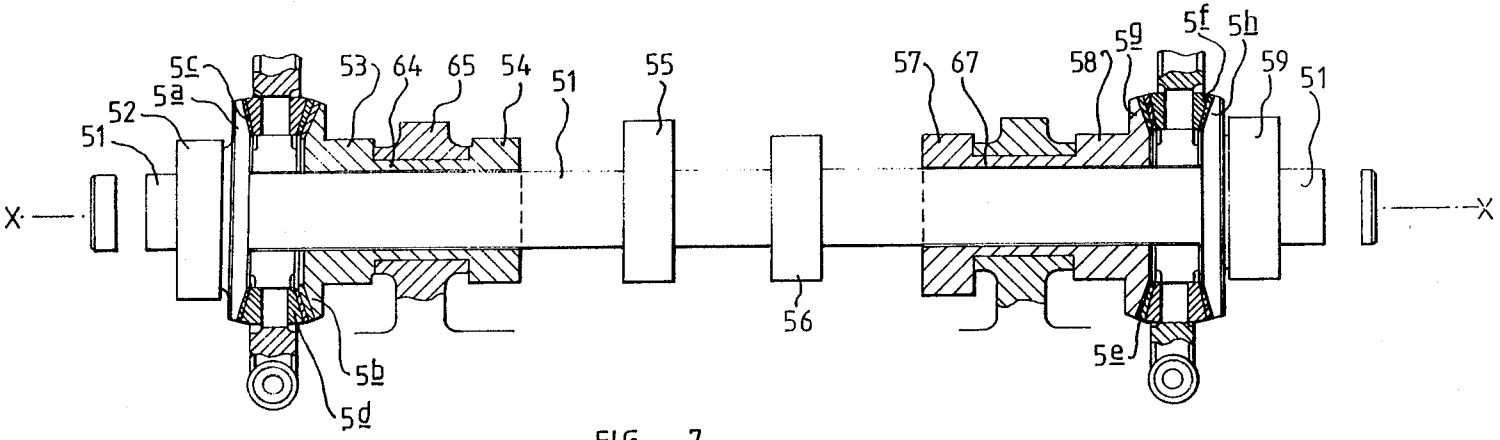
FIG. 7 shows the principles of the invention applied to an eight valve camshaft unit.

FIG. 7 is a layout for a simple eight valve camshaft unit in which the inlet valves are fixed to the camshaft and the exhaust valves are carried upon concentric sleeve-shafts.

This camshaft arrangement, suitable for the four cylinder in-line engine, allows timing changes to be effected within the area of a single camshaft. However, if a lay-shaft were introduced, the second differential unit could be eliminated. Cams 57, 58 could be derived off sleeve-shaft 64, or the two differentials could be driven and controlled by a single worm/worm-wheel combination.

The two assemblies 5b, 53, 64, 54 and 59, 58, 67, 57 can change phase relative to assembly 1/2/c/5/6/h/9 through 360° if required and can be locked in position according to requirement.

The differential camshafts described through FIGS. 1 to 7 achieve differential action by way of gears and/or levers of the pivoted type.

Figure 8:
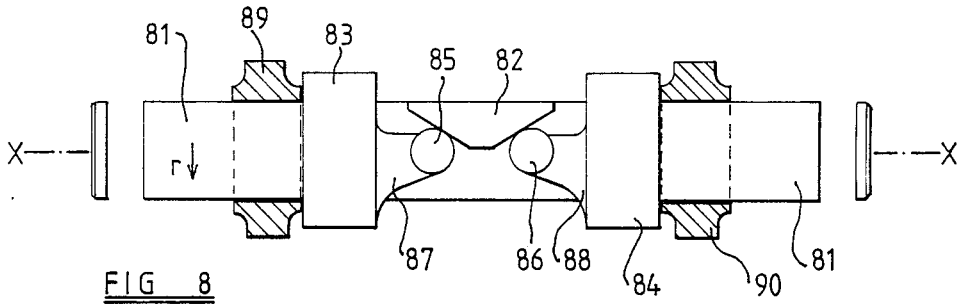
FIG. 8 shows an embodiment of the invention using cam action to replace a differential carrier.

FIG. 8 shows a device which uses a cam action in place of the differential unit of FIGS. 1 to 6.

Follower 85 is fixed to, or part of the follower-arm 87, which is, itself, fixed to, or part of cam 83. Cam 83 is mounted, in free-running bearing location, concentrically upon camshaft 81. Similarly, follower 86 is fixed to, or part of follower-arm 88 which is fixed to, or part of cam 84. This is also concentrically mounted upon camshaft 81 in free-running bearing location. Followers 85, 86 are shown to be in constant communication with the two sloping faces of the double-cam 82 which is fixed to, or part of camshaft 81.

It should be emphasised that FIG. 8 is purely diagrammatic and that the double-cam 82 would require to be radially curved in such a way as to allow for maximum contact between its driving faces and the two followers 85 and 86.

Assuming that the valve-spring loadings and component inertia is of usual proportions, then the resistance felt by the cams 83 and 84 will be more than sufficient to keep followers 85 and 86 in constant contact with the driving faces of the double-cam 82 (the rotational direction r as indicated can be reversed by repositioning the double-cam, or by providing a second double-cam for example).

As assemblies 83, 87, 85, and 86, 88, 84 are laterally restricted by the bearings indicated at the Main Journals 89 and 90, (or other means), any rotation of camshaft 81 as indicated will cause cams 83, 84 to rotate in a similar direction and at a similar speed.

If, however, while rotating as indicated, (r), camshaft 81 is moved laterally (in either direction) by any suitable amount, the cam action created by the double cam 82 will, in respect of one assembly, cause it to accelerate relative to the camshaft 81, and in the case of the other, allow it to decelerate. The lateral movement of the double-cam will, if moved from left to right as shown, cause assembly 86, 88, 84 to accelerate, and assembly 83, 87, 85 to decelerate relative to the camshaft 81.

Therefore, by providing a double-cam 82 between each pair of inlet and exhaust cams and by providing a means of rotating the camshaft 81 and providing a controlled lateral movement in either direction to the said camshaft, full differential phase control can be added to any present single camshaft engine in a very effective and simple way.

The drive-sprocket (not shown) could be splined so as to allow lateral movement of the camshaft and, if this type of arrangement was used in the three cam (Diesel) situation, wherein it might be required that the fuel cam be kept constant, then the double-cam could be divided with the fuel cam situated between the two sections. This would require the fuel cam to be wider than normal in order to allow for the lateral movement or, as in the case of the sprocket (or drive gear), this too could be splined.

A further variation would be to fix, for example, the inlet cam to the camshaft and only provide differential drive to the exhaust cam assembly. If, instead, of a double-faced driving cam 82 a slot or spline were used, then the assemblies can be driven in either direction.

Figure 9:
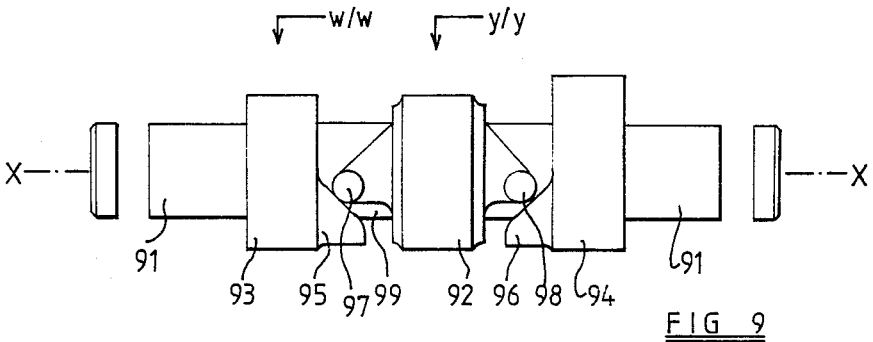
FIG. 9 is a plan view of FIG. 8.
Figure 10:
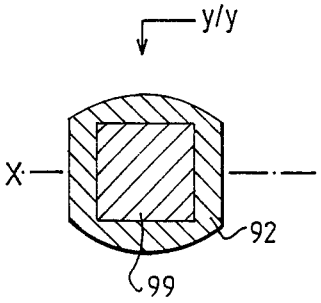
FIG. 10 is a view on the line Y/Y of FIG. 9.
Figure 11:
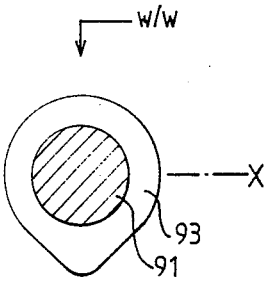
FIG. 11 is a view on the line W/W of FIG. 10.

FIG. 9 together with FIGS. 10 and 11 is a camshaft assembly which uses both lateral movement and rotational movement to effect timing variation.

A phase changing device as suggested in respect of FIG. 1 for example, will be interposed between cam 93 and camshaft 91. If, therefore, cam 93 is rotated relative to camshaft 91 in, for example, a direction opposite to that of the camshaft rotation, then the face-cam 95 will cause follower 97 to respond by causing saddle 92 to move laterally away from cam 93, and in doing so, cause follower 98 to engage face cam 96 with a driving pressure sufficient to cause rotation of cam 94 relative to camshaft 91. The square-section 99 will ensure that the saddle 92 cannot rotate other than in unison with camshaft 91.

If, in a diesel application (three cam layout etc), the fuel cam were mounted upon the saddle 92, it could remain constant with the camshaft although a wider cam would again be required. Lateral movement of cams 93 and 94 would, of course, be restricted.

Throughout this specification the various methods of achieving differential cam action have been described in terms of 'inlet' and 'exhaust' cams etc. However, these are terms of identification only and any type of descriptive term in respect of functional intention can be included. While the single camshaft capability is very important, most engines built throughout the world being single camshaft units, it should be understood that if these arrangements are used in twin or multi camshaft engines, then the ability to alter the events and periods of any valve combination can be enjoyed.

The use of bevelled gears in the various differential mechanisms is included for simplicity. However, any type of differential gearing can be substituted and ratio changes between the various elements can be contemplated.

Throughout the specification, it is envisaged that the followers mentioned can, if required, be replaced by rollers.

I claim:

1. A camshaft arrangement comprising a shaft defining an axis of rotation; first and second cams mounted on the shaft for rotation about the axis of rotation, at least one of the first and second cams being rotatable relative to the shaft; means maintaining the first and second cams at a given axial spacing on the shaft; a coupling axle projecting radially from the shaft and fixed to the shaft for rotation therewith; a coupling element rotatably mounted on the coupling axle and engaged with the first and second cams so as to couple with the cams for rotation about the axis of rotation with a selected relative phase; and phase adjusting means for adjusting the relative positions of the shaft and the first and second cams to vary the engagement between the coupling element and the first and second cams to vary the selected relative phase of rotation of the first and second cams about the axis of rotation.

2. A camshaft arrangement as claimed in claim 1 wherein both the first cam and the second cam are rotatable about the axis of rotation relative to the shaft.

3. A camshaft arrangement as claimed in claim 2 wherein the phase adjusting means comprises means to rotate the first cam relative to the shaft in one rotational direction and thereby rotate the second cam relative to the shaft in the other rotational direction.

4. A camshaft arrangement as claimed in claim 3 comprising an input gear rotatable with the first cam and an output gear rotatable with the second cam; and the coupling element comprising an idler gear engaged with the input gear and the output gear.

5. A camshaft arrangement as claimed in claim 3 comprising an input bevel gear rotatable with the first cam and an output bevel gear rotatable with the second cam, and the coupling element comprising an idler bevel gear engaged with the input and output bevel gears.

6. A camshaft arrangement as claimed in claim 3 wherein the coupling element comprises a coupling lever mounted on said axle for pivoting thereon, the coupling lever comprising a pair of lever arms operatively engaged with respective ones of said first and second cams, so that the coupling lever is rotated by a rotation of the first cam relative to the shaft to effect rotation of the second cam.

7. A camshaft arrangement as claimed in claim 5 wherein the first and second cams rotate about the shaft with a selected relative angular phase and the phase adjusting means comprises drive means for rotating the shaft through a selected angle to select the relative angular phase of the cams.

8. A camshaft arrangement as claimed in claim 7 wherein the phase adjusting means comprises a worm-wheel fixed to the shaft for rotation therewith and a worm engaged with the worm-wheel to rotate the worm-wheel and thus rotate the shaft.

9. A camshaft arrangement as claimed in claim 1 wherein one of the first and second cams is nonrotatable relative to the shaft.

10. A camshaft arrangement as claimed in claim 4 comprising an input gear rotatable with the first cam and an output gear rotatable with the second cam, and the coupling element comprising an idler gear engaged with the input gear and said output gear.

* * * * *